United States Patent [19]

Seefeldt

[11] Patent Number: 4,593,176

[45] Date of Patent: Jun. 3, 1986

[54] UNIT FOR CONVERTING A FOSSIL FUEL BURNING FURNACE INTO AN ELECTRICAL FURNACE

[76] Inventor: William J. Seefeldt, 400 S. Pine St., Monticello, Minn. 55362

[21] Appl. No.: 513,603

[22] Filed: Jul. 14, 1983

Related U.S. Application Data

[63] Continuation-in-part of Ser. No. 216,160, Dec. 15, 1980, abandoned.

[51] Int. Cl.[4] ..... H05B 1/02; F24H 3/04; F24D 5/00

[52] U.S. Cl. ..... 219/279; 165/29; 219/364; 219/365; 219/370; 219/376; 219/485; 237/2 A

[58] Field of Search ..... 219/364, 365–370, 219/375, 376, 279, 485; 165/29; 237/2 R, 2 A, 2 B

[56] References Cited

U.S. PATENT DOCUMENTS

| | | | |
|---|---|---|---|
| 2,242,630 | 5/1941 | Steingruber | 219/279 X |
| 2,449,755 | 9/1948 | Taylor | 219/364 X |
| 2,458,268 | 1/1949 | Hinds | 219/375 X |
| 2,759,708 | 8/1956 | Burgess | 219/279 X |
| 2,893,639 | 7/1959 | Martin | 219/279 X |
| 2,971,076 | 2/1961 | Ferguson | 219/364 |
| 3,061,706 | 10/1962 | Lunbom | 219/364 X |
| 3,084,741 | 4/1963 | Millspaugh | 219/364 X |
| 3,098,145 | 7/1963 | Raymond | 219/366 |
| 3,906,242 | 9/1975 | Stevenson | 219/485 X |
| 4,417,131 | 11/1983 | Carl | 219/279 |

FOREIGN PATENT DOCUMENTS

| | | | |
|---|---|---|---|
| 1082759 | 7/1980 | Canada | 219/279 |

*Primary Examiner*—A. Bartis

*Attorney, Agent, or Firm*—James R. Cwayna

[57] ABSTRACT

A unit for converting a fossil fuel burning furnace into an electrical furnace for utilization of electrical energy for heating, except under those periods of high energy usage during which the cost of electrical power is high, or during periods when extreme loads exist upon the electrical supply. During such times, a control system is provided to automatically revert the furnace to a fossil fuel burning operation. The unit includes an electrical heating device including a plurality of electrical heating elements arranged in a vertically staggered array for insertion into the ductwork of the fossil fuel burning forced air furnace, such that the elements are in close association to the plenum of the furnace and such that the fan or blower of the furnace provides air flow past such elements.

The unit includes a positionally extensible air deflector extending across the plenum in parallel relation to the heating elements such that the air being delivered from the fan or blower of the furnace is properly dispersed past the electrical heating elements prior to delivery through the ductwork.

The unit further includes temperature sensing mechanisms to control the fan or blower of the furnace system to control air flow when the electrically heated air reaches a predetermined temperature. A residual heat sensor controls the operation of the electrical heating elements to prevent energization thereof until the residual hot air from the heat exchanger has been dispersed.

4 Claims, 8 Drawing Figures

UNIT FOR CONVERTING A FOSSIL FUEL BURNING FURNACE INTO AN ELECTRICAL FURNACE

This application is a continuation-in-part of an application Ser. No. 06/216,160 filed Dec. 15, 1980, now abandoned entitled Unit for Converting a Fossil Fuel Burning Furnace into an Electrical Furnace.

FIELD OF THE INVENTION

This invention relates generally to auxillary heating units insertable into the ductwork of a forced air fossil fuel burning furnace, and more specifically, to such an electrical unit insertable into the ductwork of such a furnace, the unit being mounted in close association to the plenum of the furnace such that the electrical energy is utilized as a primary heating source and which is designed to return the furnace to fossil fuel consumption during periods of high electrical energy consumption such as peak use times or those periods of times during which the cost of electrical energy is high.

SHORT SUMMARY OF THE INVENTION

An electrical heating unit which is arranged for insertion into the ductwork of a fossil fuel burning, forced air furnace such that the furnace will normally supply heat through the electrical device but during those times of high electrical power usage or those periods of times during which high loads exist on the electrical lines, The furnace will be returned to its fossil fuel burning operation. The unit is arranged in close association to the plenum and therefore in close association to the heat exchanger portion of the fossil fuel burning furnace to take advantage of the blower of the furnace, and which, in such position, is available to distribute the electrically heated air throughout the entire ductwork of the space to be heated. The unit includes controls to coordinate the now dual furnace system, and to utilize the fan of the fossil fuel burning furnace for the distribution of heated air from either source.

One of the controls of the device includes temperature sensing means for controlling the energization of the electrical units only when residual heat from the plenum has been dispersed, and alternatively, provides means for energizing the blower of the furnace only when the electrical units sufficiently heat air for distribution through the system.

BACKGROUND OF THE INVENTION AND PRIOR ART

To the best of the applicant's knowledge, and prior to the citation of various prior art patents during the prosecution of the parent application, the most specific art appeared to be electrical units which were directly insertable into individual duct arms of forced air units, which were then employed to heat the air within the various arms of the duct system and which did not provide any central heating unit for the distribution of heat to the entire duct system, and which did not employ any arrangement for cooperation with the provided furnace and blower structure of the furnace. Further, to the best of the applicant's knowledge, no units existed which were primarily electrical heating operational units which provided control means for returning the unit to fossil fuel operation when the electrical supply is in a peak use condition or the cost of the electricity supplied is in a high rate condition.

It is common knowledge that power companies now may control use of electrical energy by various means. Some such means include timer devices for limitation of electrical useage during normal high power useage and also include signal devices which are controlled by power companies which will signal the electrically operated unit that power for its operation is being discontinued or alternatively is available. With applicant's device, the operation of a fossil fuel burning, forced air furnace is basically reversed. The unit is primarily an electric furnace except during peak power useage times, and during these peak power useages, the operation of the combination reverts to fossil fuel burning operation.

During the prosecution of the parent application, the following patents were cited by the Examiner: Martin, No. 2,893,639; Hinds, No. 2,458,268; Ferguson, No. 2,971,076; Lundbom, No. 3,061,706; Raymond, No. 3,098,145; Steinbruber, No. 2,242,630; Burgess, No. 2,759,708; Millspaugh, No. 3,084,741; and Taylor, No. 2,449,755.

Units disclosed by Lundbom, Steingruber, Burgess, and Taylor, are no more than simple electrical heating units, and there is no correlation between a simple electrical heating unit and a device which provides for operation in a preferred mode and switching from this preferred mode to a secondary operational mode.

Patents to Raymond and Millsbaugh disclose air conditioning systems which are utilized in conjunction with forced air systems, and again have no correlation to a unit which operates in conjunction with a fossil fuel burning furnace for heat generation. Obviously, when an air conditioning system is in operation, it is not desirable to switch between heating systems.

The patent to Martin is a combination of an electrical and fuel burning furnace, but on a general basis may be considered as totally opposite in operation to the unit of the applicant. In the Martin patent, the fuel burning heater remains inactive as long as the electrical supply is able to maintain the space at desired temperature. Should a drop in temperature result in the air to be heated, then the fuel burner takes over.

The Hinds patent is a simple structural disclosure which illustrates a staggering of heating elements and the provision of air guiding baffles.

It is the opinion of the applicant that these cited references do not properly serve to disclose, to one skilled in the art, the objects and advantages of the applicant's device, and likewise, they do not illustrate the structure of the device so as to prevent the patentability thereof.

It is therefore an object of the applicant's invention to provide a conversion unit for converting a normal fossil fuel burning, forced air furnace, into an electrically powered furnace wherein the fossil fuel operation is maintained, retained, and controlled for operation during those periods when electrical power is not available at a desired operating level or at a period when electrical power would be excessively expensive.

It is a further object of the applicant's invention to provide an electrically powered heating source for useage in close association to a fossil fuel burning, forced air furnace, which electrically powered heating source provides control means for utilization of various portions of the fossil fuel burning furnace, such as the air distribution blower.

It is still a further object of the applicant's invention to provide an electrically operated and energized heating system which is insertable into the ductwork of a fossil fuel burning, forced air heating system, wherein the electrically energized system is available for generation of heat at all off-peak electrical useage periods.

It is still a further object of the applicant's invention to provide an electrical heating system for use with a fossil fuel burning, forced air furnace, which forced air furnace may include an "A", air conditioning coil unit.

It is still a further object of the applicant's invention to provide control means for operation of an electrical heating system which operates in conjunction with a fossil fuel burning, forced air burning system, which prevents the energization of electrical heating elements of the electrical heating system while residual heat remains from prior operation of the fossil fuel burning portion of the combination.

It is yet another object of the applicant's invention to provide control mechanisms for an electrically powered heating system for use in conjunction with a fossil fuel burning, forced air heating system with such controls coordinating operation of the supplied elements as required.

These and other objects of the applicant's invention will more clearly appear from the following description made in association with the accompanying drawings.

SHORT DESCRIPTION OF THE DRAWINGS

Figure 8:
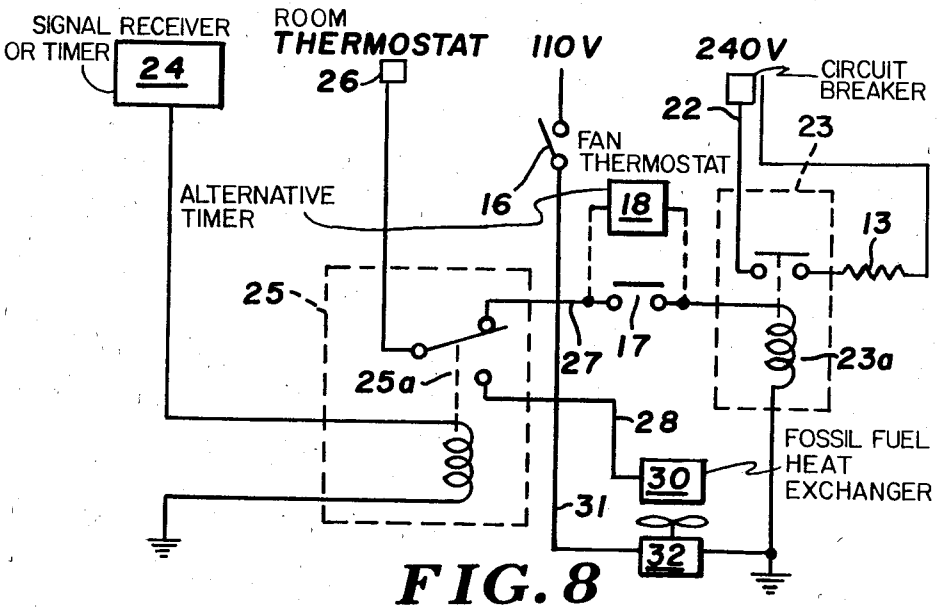
Figure 3:
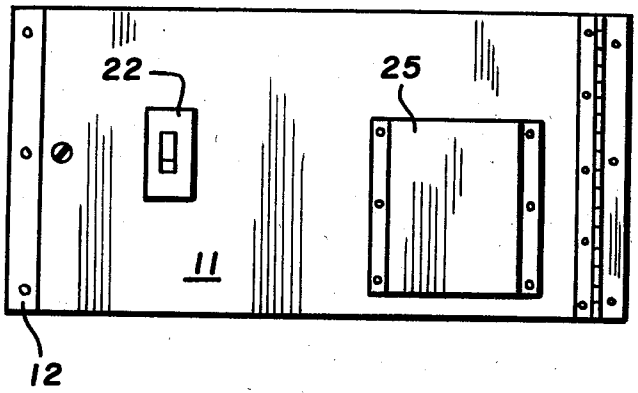
FIG. 3 is a front elevation view thereof.
Figure 7:
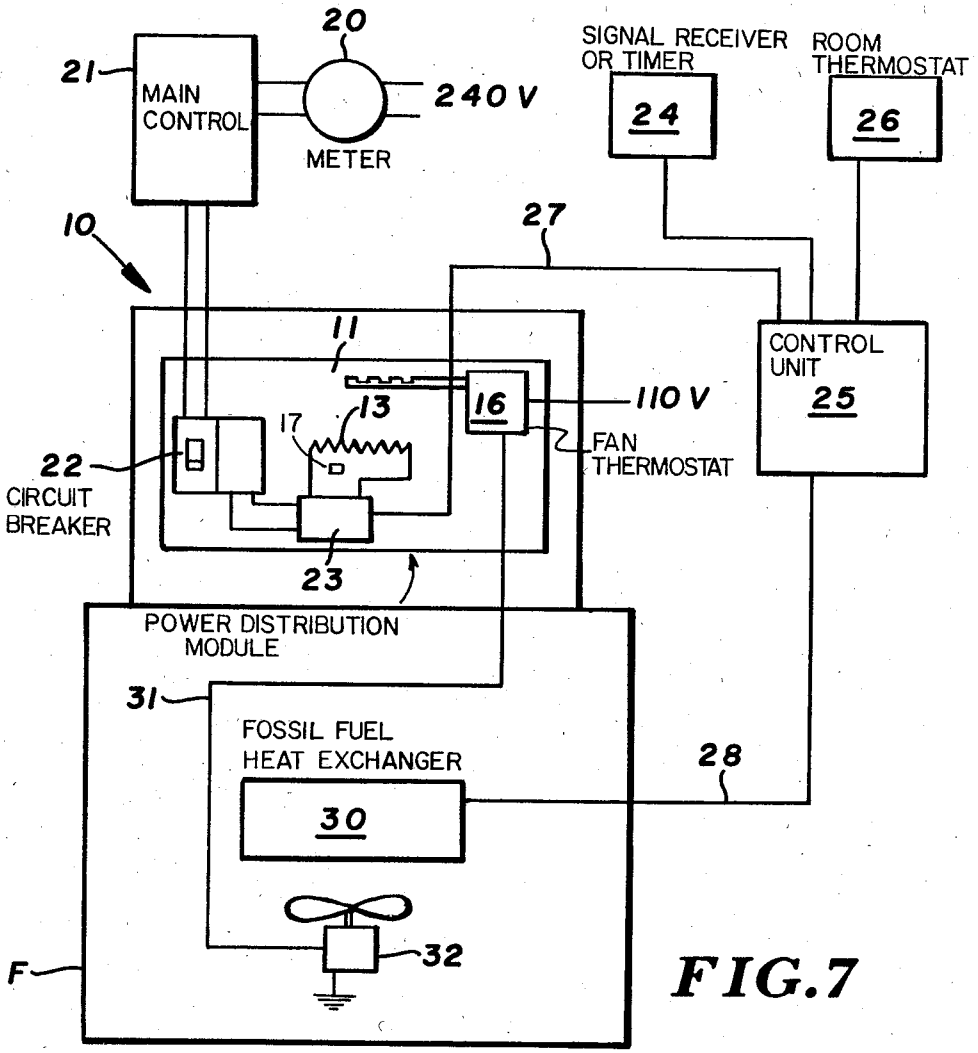

FIG. 7 is a schematic illustration of a typical installation of the applicant's electrical heating unit in conjunction with a fossil fuel burning, forced air furnace; and, FIG. 8 is an electrical schematic illustration of a typical wiring arrangement for the operation of applicant's invention to afford power useage for the electrical heating unit and to control the fossil fuel burning, forced air furnace.

DESCRIPTION OF A PREFERRED EMBODIMENT OF THE INVENTION

In accordance with the accompanying drawings, the applicant provides a self-contained unit, designated 10, which is designed to be installed within the plenum system of a forced air heating system and in close association to the heating unit thereof which operates in combination therewith.

Figure 6:
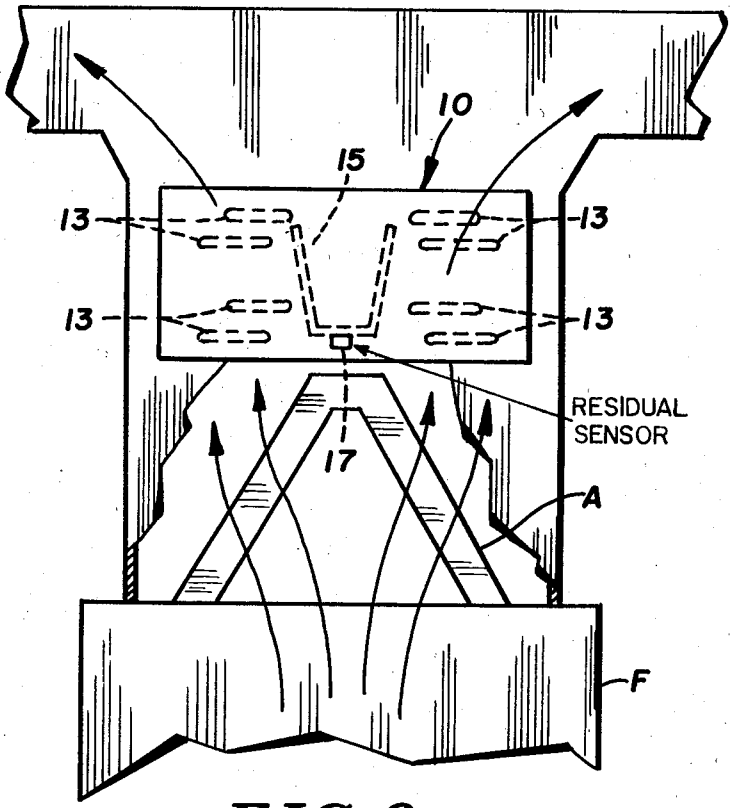
FIG. 6 is a side elevation view of a typical fossil fuel, forced air furnace and associated air conditioning coil and a portion of the accompanying plenum into which the electrical unit embodying the concepts of the applicant's invention is installed.

A fossil fuel burning, forced air furnace F is provided and, as illustrated in FIG. 6, the unit 10 is positioned above the furnace F, and, FIG. 6 further illustrates a forced air sytem which includes an air conditioning "A" coil which is designated A.

This air conditioning coil inclusion illustrates a most complete unit but the common installation does not include this unit in which case, unit 10 is mounted in close proximity to and with zero physical clearance to furnace F.

An air conditioning coil A, as is well known in the art, is generally of an A-cross sectional shape, and the air from the blower unit 32 of the furnace F is passed therethrough for cooling. When such an air conditioning coil A is installed in the forced air system but not operative, it is obvious that the air from the blower unit 32 will pass therethrough, and the applicant's unit 10 is designed to receive all of the air passing therethrough to heat the same, and likewise, when such an air conditioning coil is not in the system, all of the air from the blower 32 will pass directly through the heating portions of the unit 10.

Furnace F provides a fossil fuel burner 30 and a blower 32 with an electrical control line 28 provided to activate burner 30, and a control line 31 provided to activate blower 32 of the furnace unit as controlled.

As stated in the objects and summary of the invention, the concept of applicant's device is to provide a heating unit which normally operates from electrical power, but when demands are made for such power for other uses, the power company may signal this unit and therefore, cut off the electrical power for heating. Unit 10 may be time controlled as by element 24 in such a manner so as not to use electrical power during high peak useage which corresponds to high cost periods of useage, and during such reduced or cut off periods, reversion to a fossil fuel burning system is provided to continue to heat the space.

Unit 10 provides a first, generally rectangular module 11, which contains the various controls for electrical distribution, and which is provided with an outstanding flange 12 to permit mounting the same against the plenum of the system. A normal plenum of a forced air furnace is generally rectangular in shape, and unit 10 is designed to fit against one side of the plenum without removal of any ductwork sections.

Figure 5:
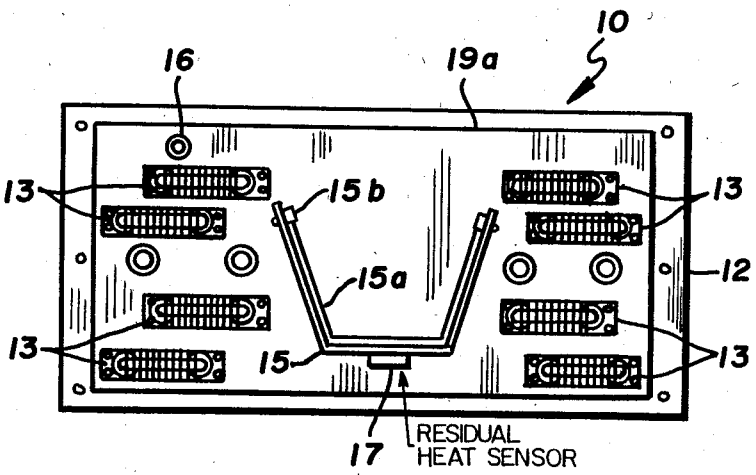
FIG. 5 is an end view thereof taken opposite the view of FIG. 3.

A plurality of electrically powered heating elements 13 are arranged to extend outwardly from module 11 and therefore extend inwardly into the plenum area to closely overlie furnace F and providing zero clearance therebetween. It is well known that in a fossil fuel burning furnace, a plenum is provided for the heating of the air, and these electrically powered heating elements 13 are arranged upwardly from the plenum. Elements 13, as shown, are externally finned to provide an expanded heating area for air that is passed thereby, and, as illustrated in FIG. 5, these elements 13 are arranged in outwardly spaced relation from a general central area of module 11, and as also illustrated, the same are in a staggered, upwardly positioned relationship to one another adjacent the side of the module 11. Characteristically, the prior art provides for uniform heating element positioning rather than such a staggered relationship.

Heating elements 13 are electrically responsive and electrically powered units and no further description is deemed necessary with this statement except that the spacing thereof is elected to ensure that air moving upwardly therethrough will be exposed to the heating elements for heating thereof, and therefore the offset or staggered relationship is deemed essential to provide a tortuous path to increase the heat transfer from the heating elements 13 to the air. Such heating elements 13 are normally designed to operate under 240 V and such voltage is defined herein to be a second power source with certain other portions of the unit designed for operation under 110 V which is defined as a first power souce. It being understood that such voltage levels are commonly provided through 240 V service systems.

Although such heating elements are commercially available, applicant has found that the prior art, with the exception of certain patents which were disclosed in prosecution of the parent application, had only employed "open" or non-finned elements.

Arranged intermediate the heating elements 13 is a generally flat bottomed, V-shaped, air deflector or guiding member 15 positioned and constructed to deflect air from the heat exchanger area of the furnace F outwardly as the same is directed upwardly to ensure exposure of such air to the heating elements 13. This deflector or air guiding member 15 likewise ensures such air direction when an air conditioning coil A is utilized in conjunction with the furnace F. As illustrated, deflector or air guiding element 15 is provided with an extensible slide element 15a, having a pair of clamping elements **15*b*** for positioning the slide element 15*a* with respect to the deflector body 15. Obviously, a first end of the deflector 15 must be secured to the module 11. Slide element **15*a* is extensible across the entire plenum. The purpose of the deflector 15 is, as stated, to deflect the air to the sides of the ductwork and thus ensure that it is thoroughly exposed to the heat of the heating elements 13. Arranged on the lowermost portion of the deflector 15 is a residual heat sensor 17, the purpose of which is to sense the temperature of air being received from the heat exchanger area of the furnace F. More specifically, the purpose of such residual heat sensor 17** will be described hereinafter.

It should be obvious, then, that a major concept of thorough air heating and air flow through the plenum is the elimination of central air flow without heating the same. With the applicant's arrangement central air is baffled and directed to the sides of the plenum area for more effective heating and heat transfer from heating elements 13.

Fan thermostat 16 is provided on the unit 10 to extend inwardly into the plenum from the module 11, and to be in close association to the heating elements 13. The purpose of this particular control 16 is to measure the temperature of air being heated by elements 13 and to provide by switching a connection to the fan or blower 32 of the provided furnace F. When, for example, the electrical heating unit 10 and heating elements 13 are actuated and in operative condition, the accumulation of heat will require and demand that the same be delivered throughout the ductwork of the space to be heated. When the temperature of the heated air reaches a predetermined level, the fan or blower 32 of the furnace F will be actuated to force the air through the ductwork system.

Contrary to such operation, there are periods of time in which the fossil fuel burning furnace has been operating and there is an accumulation of heat in the heat exchanger or plenum area. Sensor 17 monitors this residual heat and if this residual heat is relatively high, residual heat sensor 17 controls the operation of the entire unit 10, and will not allow energization of elements 13 until this residual heat has either been expelled by operation of blower 32 or has risen from such area of the entire unit simply cools off.

An example of this residual heat sensor 17 operation is as follows: On the occasion when the fossil fuel burning furnace has been operating due to lack of sufficient electrical power for operation of heating elements 13 of the unit 10 or control by the power company, there will be an accumulation of residual heat in the heat exchanger area. At this point, power may become available for operation of the heating elements 13 of unit 10. Thermostates 26 serving as switch actuating means associated with the space to be heated will, if so set, call for more heat to such space. As heat is available from the previous utilization of the fossil fuel burning heat exchanger, it is not necessary to operate the heating elements 13 of unit 10 until the heated air from the heat exchanger useage has been expelled. Therefore, residual heat sensor 17 will prevent operation of the unit 10 until this residual heated air has been expelled, at which time it will allow the heating elements 13 of unit to become functional and operative. As an alternative, a timer 18 may be incorporated to prevent energization of elements 13 for a period of time after power is available and the fossil fuel operation has ceased.

Figure 1:
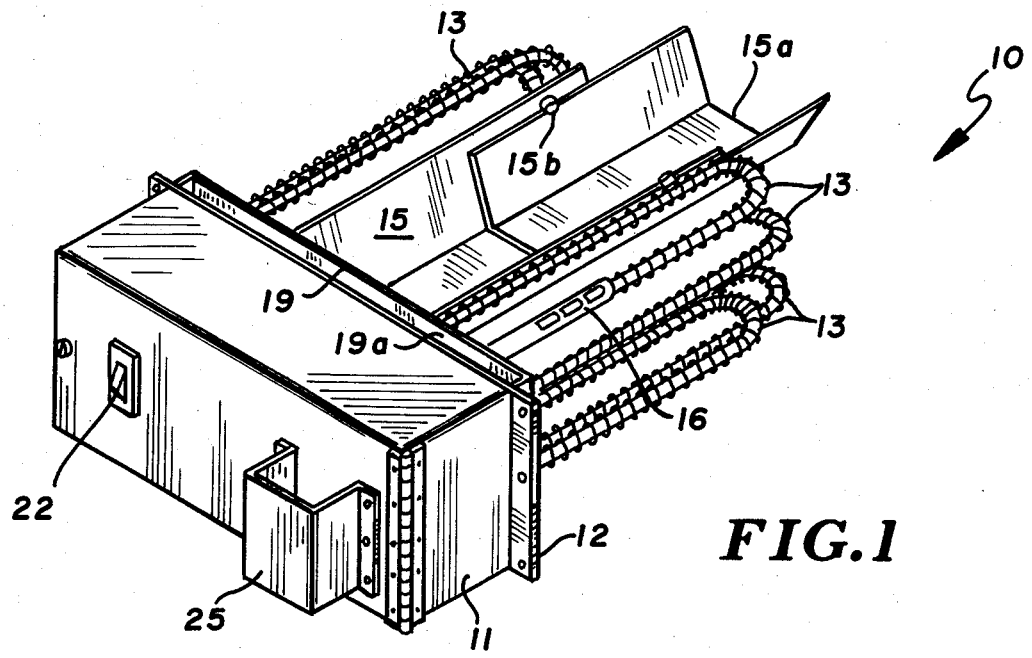
FIG. 1 is a perspective view of an electrical heating unit embodying the concept of the applicant's invention.
Figure 2:
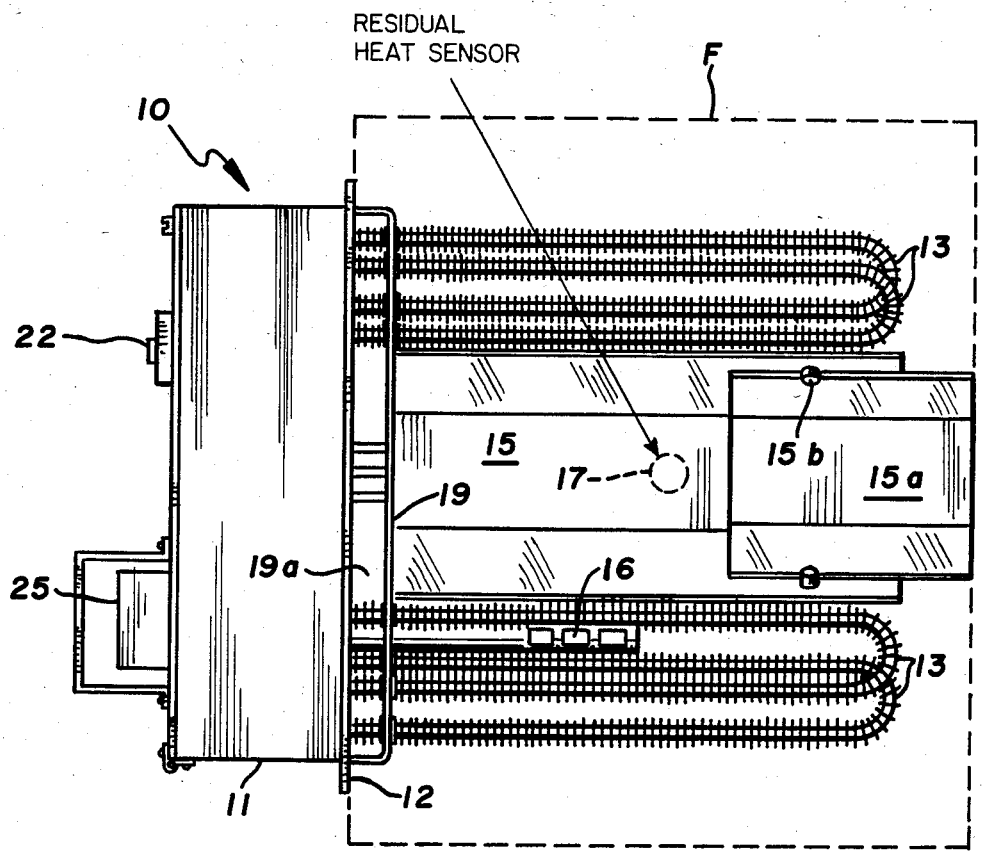
FIG. 2 is a top plan view thereof illustrating the plenum of the system in dotted lines.
Figure 4:
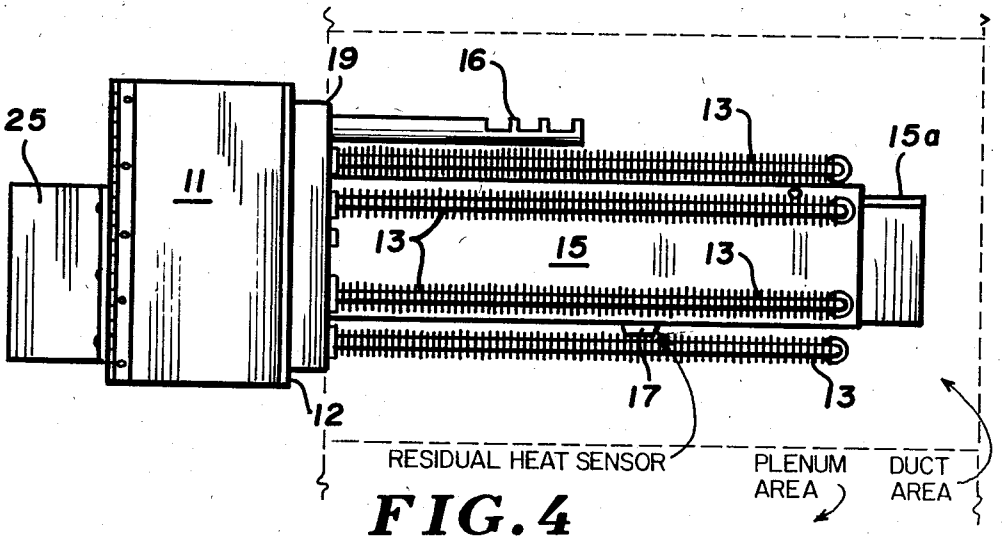
FIG. 4 is a side elevation view thereof.

As particularly illustrated in FIGS. 1, 2, and 4, an isolation panel 19 is provided on the inner side of module 11. This panel 19 is spaced from the control module 11 and is arranged to be positioned inwardly of the plenum of the system. The concept of the isolation panel 19 is to provide an air flow chamber **19*a* between the relatively high temperature area of the elements 13 and the control module 11. Applicant has found that this flow chamber 19*a* will retard any heating of the controls arranged within module 11**, and will ensure the longevity thereof.

Two schematic illustrations are utilized to explain and disclose the interconnections between the unit 10 and the provided furnace F. FIG. 7 may be referred to as a mechanical-electrical schematic, while FIG. 8 is primarily an electrical schematic.

As illustrated in FIG. 7, the unit 10 is inserted into the plenum of the furnace F module unit 11 including the aforementioned heating elements 13 to extend into the plenum, fan theremostat 16, a normally supplied circuit breaker 22 to receive 240 volts delived to the unit from a power source through meter 20 and control box 21. Module 11 also includes a power distribution means designated 23 and the 240 volt second power source is controlled for distribution to heating elements 13 therefrom. A control module is likewise provided and designated 25 and is illustrated on the exterior of the module 11 in FIGS. 1, 2, 4, and 5. A triggering mechanism or signalling mechanism 24 is connected to the control module 25 and, as stated, this machanism may be remotely controlled by a power company or may be a timer which is simply preset to correspond to normal off-peak usage periods during which the electrical power available is utilized as the primary heating source. Thermostat 26 responsive to the space to be heated are also provided to the control module 25 to signal requirements of heat within the space. As further illustrated in FIG. 7, a connection from control module 25 is provided to the fossil fuel heat exchanger 30, through line 28 to actuate the same whenever a high peak power useage occurs such that fossil fuel heat will be provided to the space to be heated.

Fan thermostat 16 is illustrated to be in close relationship to the heating elements 13 and this fan thermostat is connected through control line 31 to the blower 32 for actuation thereof whenever the heating elements 13 raise the temperature of the air above a predetermined level and a call is made for heat through thermostat 26. Power is delivered to this fan thermostat 16 through a 110 volt supply.

It is well known in the art that various metering and register units are available and used dependent upon the wishes and desires of the various power companies. It is common to meter the use of 240 volts and to separately meter the use of 110 volts, and this is often done singularly or in various combinations.

A basic concept of the applicant's invention is to provide a system requiring no modifications to the existing furnace other than a means for signalling the blower thereof to operate and to signal the fossil fuel burner to supply heat.

As also illustrated in FIG. 7, a connective line 27 is, of essence, provided between the 240 volt distribution means 23 and control module 25.

Operation of the unit should be obvious from a consideration of FIG. 7, but to further explain the same, the electrical schematic of FIG. 8 is provided.

FIG. 8 illustrates two slightly different schematics, in that in the solid line configuration thereof the previously discussed residual heat sensor 17 is inserted into the circuit and alternatively with the showing through dotted lines, the timer device 18 is substituted for the residual heat sensor 17. With this differentiation considered, the remainder of the circuit is illustrated in solid lines with the exception of certain relay positions.

For purposes of explanation of FIG. 8, the assumption is made that the required 240 volt electrical power is available for useage. In this condition, unit 24 has either received a signal from the power company; or, if a timer device, allows an actuating signal to be provided which indicates that such 240 volt power is available. This signal is transmitted to a typical relay unit **25*a* of control module 25, such that the switching control mechanism thereof 25*b* is in position to send power through line 27 and into the distribution means 23**.

As illustrated, residual heat sensor 17 or alternatively, timer element 18 is inserted in line 27. If the use of the residual heat sensor 17 is being made, the temperature of the residual air existing from previous operation of the fossil fuel burner is measured, and it this residual air temperature is above a predetermined level, switch 17 will remain open. Upon cooling of this residual air, such residual heat sensor 17 will be closed. Also, if the timer element 18 is utilized, a predetermined time delay following the transmitted signal is provided. The transmission of a signal through line 27 as further resulting from thermostat 26 to the distribution means 23 provides for actuation of relay coil **23*a* to close to transmit power from the 240 volt supply to the heating elements 13**.

Fan thermostat 16 is arranged in close relationship to the heating elements 13, and when the air heated by the elements 13 is above or at a preselected level, fan thermostat 16 will provide communication between a 110 volt supply and the furnace blower 32 through line 31.

When the heat in the space reaches its desired level, relay coil **23*a* will be deactivated through thermostat 26 to break the connection between the 240 volt supply and heating elements 13. Cooling of the air adjacent the heating elements 13 is sensed by the fan thermostat 16, and blower 32** is likewise deactivated.

Upon the end of the permitted time cycle or a signal from the power company as designated through triggering or signal unit 24, relay **25*a* will be deactivated and the switching mechanism thereof will now provide a circuit between the thermostat 26 and the fossil fuel burner 30**. When in this condition, the fossil fuel burning furnace will operate in its normal condition to provide heat as called for until the next such electrical power situation is signalled or timed. This latter situation is true due to the fact that the applicant's device does not modify any of the normal operative arrangements of the fossil fuel burning furnace except to deactivate the same when electrical power is available at a desired level and to activate the same when such electrical power is not available.

It should be obvious that the applicant has provided a new and unique unit for converting a fossil fuel burning furnace into an electrical furnace requiring no modifications therefore and simply requiring control connections thereto.

What I claim is:

1. In a fossil fuel burning, forced air heating system, such system including a fossil fuel burner associated with a heat exchanger supplying heated air to an air plenum and duct system for distribution, a fan for circulating air through the system over the heat exchanger and through the air plenum and duct system and a control system for controlling operation of the fan and burner to maintain a desired temperature in a space being heated by the system, the improvement comprising an electrical heating unit inserted into the plenum and duct system downstream of the heat exchanger and fan for use when the burner is inoperative, said heating unit comprising:

a. an electrical power distribution means;

b. a first and a second source of electrical power, said distribution means arranged to deliver power from said second source at selected intervals;

c. a plurality of heating elements being positioned in the plenum system and extending substantially across the plenum;

d. said heating elements being arranged in vertical, staggered relation to one another whereby a tortuous air flow path thereover is established;

e. an air deflector member arranged generally centrally of the unit and positionally extensible to permit said air deflector member to extend substantially across the plenum in parallel relation to said heating elements and sets of said heating elements being arranged respectively along the sides of said deflector;

f. first switch means actuated by said distribution means for delivery of electrical power to said heating elements from said second power source;

g. control means responsive to delivery of a signal thereto indicative of the availability of power from said second source to selectively ready either said distribution means for transmission of power to said heating elements from said second power source when the signal is indicative of power availability therefrom or energization of said fossil fuel burner for heat generation when the signal is indicative of power unavailability from said second source;

h. signal transmission means including signal generating means communicating with and deliverying said signal to said control means for selectively readying either said distribution means to energize said heating elements or said burner in response to the availability of power from said second source of power; and, i. thermostatic switch means associated with the space to be heated and arranged in circuit with said control means and said distribution means for controlling actuation of said first switch means in response to the temperature level within the space to be heated.

2. The combination of claim 1 and said air deflector defining a frusto-triangular cross section and being in inverted position within said plenum and duct system.

3. The combination of claim 1 and;

a. a temperature sensing switching means closely associated with said heating elements to sense the heat of the air being heated by said elements;

b. said temperature sensing switching means being responsive to the temperature of the air heated by said heating elements and connected to the fan of the forced air furnace for actuation thereof when the temperature of the air heated by said heating elements reaches a predetermined level;

c. another temperature sensing switching means closely associated with the fuel burner of the furnace to sense the temperature of the air within the plenum and duct system heated by the burner; and, d. said another temperature sensing switching means arranged in circuit with said control means and said distribution means to ready said distribution means to transmit power to said heating elements when the air temperature within the plenum and duct falls below a selected level.

4. The combination of claim 1 and timer switching means arranged in circuit with said control means and said distribution means to ready said distribution means to transmit power to said heating elements a predetermined time subsequent to the transmission of a signal from said signal transmission means to said control means.

* * * * *